US008121500B2

(12) United States Patent
Mitamura

(10) Patent No.: US 8,121,500 B2
(45) Date of Patent: Feb. 21, 2012

(54) IMAGE FORMING APPARATUS, METHOD OF DETERMINING AMOUNT OF DEVELOPER SUPPLY, AND PROGRAM OF DETERMINING AMOUNT OF DEVELOPER SUPPLY

(75) Inventor: Hiromichi Mitamura, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/400,814

(22) Filed: Mar. 10, 2009

(65) Prior Publication Data

US 2009/0226194 A1 Sep. 10, 2009

Related U.S. Application Data

(60) Provisional application No. 61/035,214, filed on Mar. 10, 2008.

(51) Int. Cl.
*G03G 15/08* (2006.01)

(52) U.S. Cl. ..... 399/30; 399/61; 399/62

(58) Field of Classification Search ..... 399/9, 24, 399/27–30, 38, 58–65
See application file for complete search history.

(56) References Cited

U.S. PATENT DOCUMENTS

| | | | | |
|---|---|---|---|---|
| 7,149,439 | B2 * | 12/2006 | Hirata et al. | 399/29 |
| 7,218,871 | B2 * | 5/2007 | Ogata | 399/27 |
| 7,603,046 | B2 * | 10/2009 | Hirayama | 399/27 |
| 7,657,194 | B2 * | 2/2010 | Tanaka et al. | 399/30 |
| 7,697,854 | B2 * | 4/2010 | Itoyama et al. | 399/38 |

* cited by examiner

*Primary Examiner* — Hoan Tran
(74) *Attorney, Agent, or Firm* — Turocy & Watson, LLP

(57) ABSTRACT

To provide a technology that can realize appropriate developer supply processing according to conditions within a developing unit by a simple method. In an image forming apparatus that visualizes an electrostatic latent image formed on a photoconductor with a developing unit, information on an amount of consumption of a developer in the developing unit is acquired, first developer supply information indicating an amount of developer to be supplied to the developing unit is calculated based on the acquired information, information on concentration of the developer contained within the developing unit is acquired, second developer supply information indicating an amount of developer to be supplied to the developing unit is calculated based on the acquired information, and information indicating an amount of developer to be supplied to the developing unit is determined based on the calculated first and second developer supply information.

20 Claims, 9 Drawing Sheets

IMAGE FORMING APPARATUS, METHOD OF DETERMINING AMOUNT OF DEVELOPER SUPPLY, AND PROGRAM OF DETERMINING AMOUNT OF DEVELOPER SUPPLY

CROSS-REFERENCE TO RELATED APPLICATION

This application is based upon and claims the benefit of priority from: U.S. Provisional Application 61/035,214, filed on Mar. 10, 2008, the entire contents of which is incorporated herein by reference.

TECHNICAL FIELD

The present invention relates to a developer supply technology to a developing unit in an image forming apparatus.

BACKGROUND

In an electrophotographic process, to keep the toner concentration constant in two-component developer containing toner and carrier is very important for maintaining stable image formation quality.

As a technology for keeping the toner concentration constant, a technology of measuring the number of basic image points of image data used for printing data and controlling toner supply according to the measurement value is known. The conventional technology is to supply an amount of toner to be used or an amount of used toner to a developing unit.

Regarding the conventional toner supply system as described above, a method of correcting an amount of toner supply, if the toner concentration detected by toner concentration detecting means is off the target value, to bring the toner concentration close to the target value according to an amount of difference from the target value is disclosed (e.g., see Japanese Patent Publication No. 2942017, Japanese Patent Publication No. 3072783, or the like).

However, the conventional technology employs a complex method of calculating the amount of toner supply based on the number of pixels of image data used for printing, calculating the amount of correction according to the toner concentration in the developer, and calculating a new amount of toner supply by computation of the amount of toner supply based on the number of pixels and the amount of correction.

A sprinting processing in a high-speed printer (e.g., a so-called four-drum tandem type image forming apparatus), under the condition that calculation of plural times of toner supply in a short period is required, it is difficult to realize the calculation of the amount of toner supply in the above conventional technology at low cost because a high-speed arithmetic processing unit is needed.

SUMMARY

Embodiments of the invention are intended to provide a technology that can realize appropriate developer supply processing according to conditions within a developing unit by a simple method.

In order to solve the above described problem, an aspect of the invention relates to an image forming apparatus that visualizes an electrostatic latent image formed on a photoconductor with a developing unit, including: a consumption information acquiring part that acquires information on an amount of consumption of a developer in the developing unit; a first supply information calculating part that calculates first developer supply information indicating an amount of developer to be supplied to the developing unit based on the information acquired in the consumption information acquiring part; a concentration information acquiring part that acquires information on concentration of the developer contained within the developing unit; a second supply information calculating part that calculates second developer supply information indicating an amount of developer to be supplied to the developing unit based on the information acquired in the concentration information acquiring part; and a supply amount determining part that determines information indicating an amount of developer to be supplied to the developing unit based on the first and second developer supply information calculated in the first and second supply information calculating parts.

Further, another aspect of the invention relates to a method of determining an amount of developer supply in an image forming apparatus that visualizes an electrostatic latent image formed on a photoconductor with a developing unit, including: acquiring information on an amount of consumption of a developer in the developing unit; calculating first developer supply information indicating an amount of developer to be supplied to the developing unit based on the acquired information; acquiring information on concentration of the developer contained within the developing unit; calculating second developer supply information indicating an amount of developer to be supplied to the developing unit based on the acquired information; and determining information indicating an amount of developer to be supplied to the developing unit based on the calculated first and second developer supply information.

Furthermore, yet another aspect of the invention relates to a program allowing a computer to execute a method of determining an amount of developer supply in an image forming apparatus that visualizes an electrostatic latent image formed on a photoconductor with a developing unit, allowing the computer to execute processing of: acquiring information on an amount of consumption of a developer in the developing unit; calculating first developer supply information indicating an amount of developer to be supplied to the developing unit based on the acquired information; acquiring information on concentration of the developer contained within the developing unit; calculating second developer supply information indicating an amount of developer to be supplied to the developing unit based on the acquired information; and determining information indicating an amount of developer to be supplied to the developing unit based on the calculated first and second developer supply information.

DETAILED DESCRIPTION

As below, embodiments of the invention will be described with reference to the drawings.

First Embodiment

Figure 1:
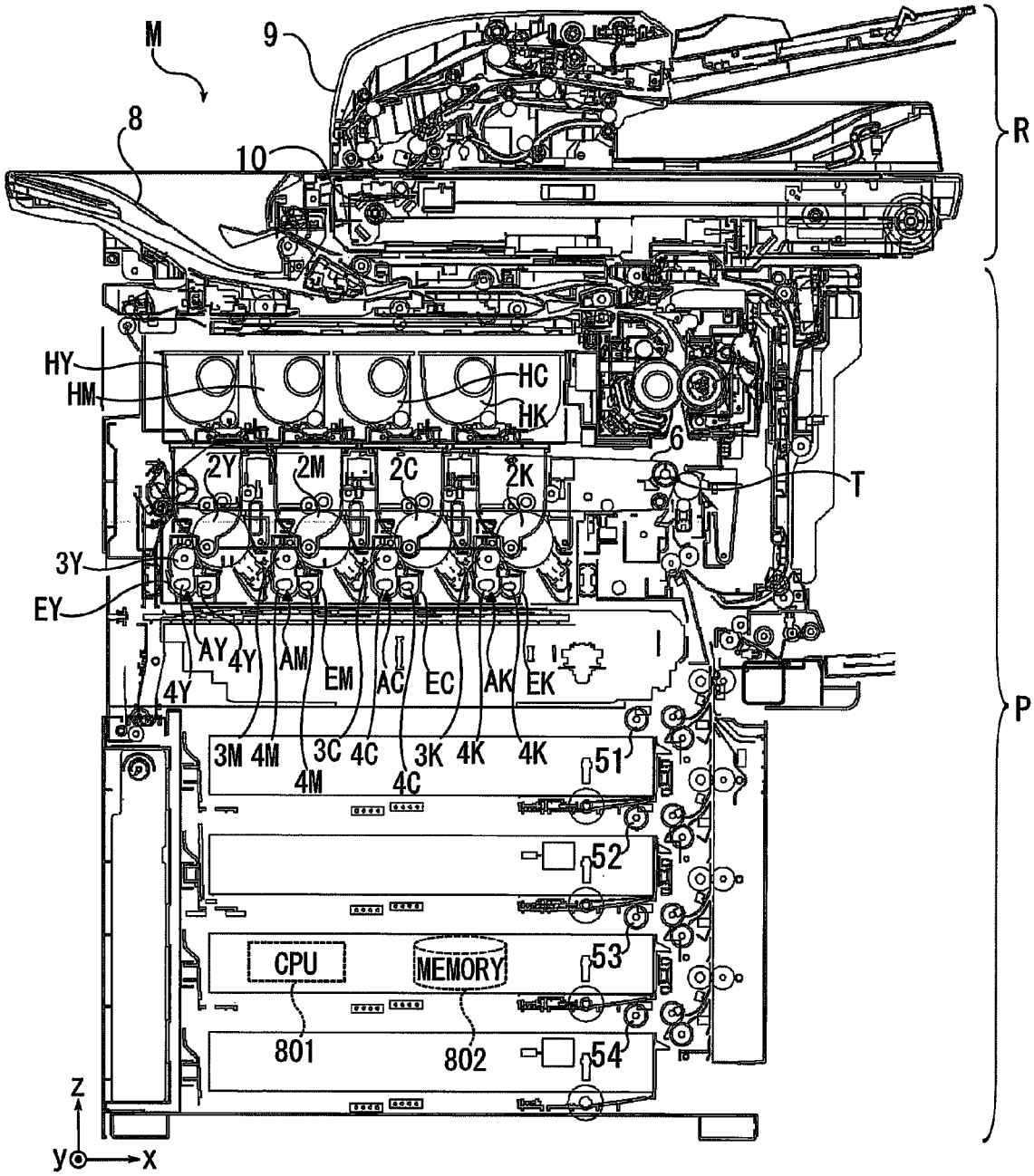
FIG. 1 is a longitudinal sectional view showing a schematic configuration of an image forming apparatus M in the first embodiment of the invention.

FIG. 1 is a longitudinal sectional view showing a schematic configuration of an image forming apparatus M in the first embodiment of the invention.

As shown in FIG. 1, the image forming apparatus M according to the embodiment includes an image reading section R and an image forming section P.

The image reading section R has a function of scanning and reading an image of a sheet original and book original.

The image forming section P has a function of forming a developer image on a sheet based on the image read from the original by the image reading section R, image data transmitted from an external device to the image forming apparatus, or the like.

The image reading section R includes an auto document feeder (ADF) 9 that can automatically transport the original to a predetermined image reading position, and reads the image of the original mounted on an original tray (a predetermined original stage) Rt to be automatically transported by the auto document feeder 9 and an original mounted on a platen (not shown) using a scan optical system 10.

Further, the image forming section P includes pickup rollers 51 to 54, photoconductors 2Y to 2K, developing rollers 3Y to 3K, mixers 4Y to 4K, an intermediate transfer belt 6, a fixing unit 7, an eject tray 8, and supply tanks HY to HK. Here, both the photoconductors 2Y to 2K and the intermediate transfer belt 6 have a role of an image carrier.

Furthermore, the image forming apparatus M according to the embodiment includes a CPU 801 and a memory 802 (see FIG. 1).

As below, as an example of processing in the image forming apparatus M according to the embodiment, an outline of copy processing will be described.

First, sheets picked up from cassettes by the pickup rollers 51 to 54 are fed into sheet transport paths. The sheets fed into sheet transport paths are transported in predetermined directions by pairs of rollers.

Then, images of sheet originals continuously and automatically transported by the auto document feeder 9 are read by the scan optical system 10 in the predetermined image reading position.

Then, electrostatic latent images are formed on photoconductive surfaces of the photoconductors 2Y, 2M, 2C, and 2K for transferring developer images of yellow (Y), magenta (M), cyan (C), and black (K) on a sheet based on the image data of the images read from the original in the image reading section R.

Subsequently, developers within developing units stirred by the mixers 4Y to 4K (corresponding to stirring parts) in developing units EY to EK are held on the roller surfaces of the developing rollers (so-called magnet rollers) 3Y to 3K and carried, and supplied to the photoconductors 2Y to 2K on which the electrostatic latent images are formed as described above. Thereby, the electrostatic latent images formed on the photoconductive surfaces of the photoconductors are visualized (developed).

Thus formed developer images on the photoconductors are transferred onto a belt surface of the intermediate transfer belt 6 (so-called primary transfer), and the developer images carried by the rotation of the intermediate transfer belt are transferred onto the transported sheet in a predetermined secondary transfer position T.

The developer images transferred onto the sheet are heated and fixed to the sheet in the fixing unit 7.

The sheet onto which the developer images are heated and fixed is transported by the pairs of transport rollers within the transport paths, and sequentially ejected onto the eject tray 8.

Further, if the total amount of the developer (here, that refers to a so-called two-component developer consisting of carrier and toner) contained within the developer units EY to EK decreases to less than an acceptable level due to image forming processing onto the sheets, or the component ratio of toner and carrier forming the developer exceeds the proper condition (for example, the amount of toner is less than an acceptable level due to toner consumption), the developer can be maintained in an appropriate concentration condition by supplying fresh toner contained within the supply tanks HY to HK into the developing units EY to EK (toner supply) via a toner transport path (not shown).

Furthermore, voltages corresponding to magnetic permeability of the developers as information on the concentration of the developers contained within the developing units 3Y to 3K are output by magnetic sensors AY to AK.

The CPU 801 serves to perform various kinds of processing in the image forming apparatus M according to the embodiment, and also serves to realize various functions by executing programs stored in the memory 802.

The memory 802 may include RAM (Random Access Memory), ROM (Read Only Memory), DRAM (Dynamic Random Access Memory), SRAM (Static Random Access Memory), VRAM (Video RAM), or the like, for example, and serves to store various kinds of information and programs used in the image forming apparatus M.

Figure 2:
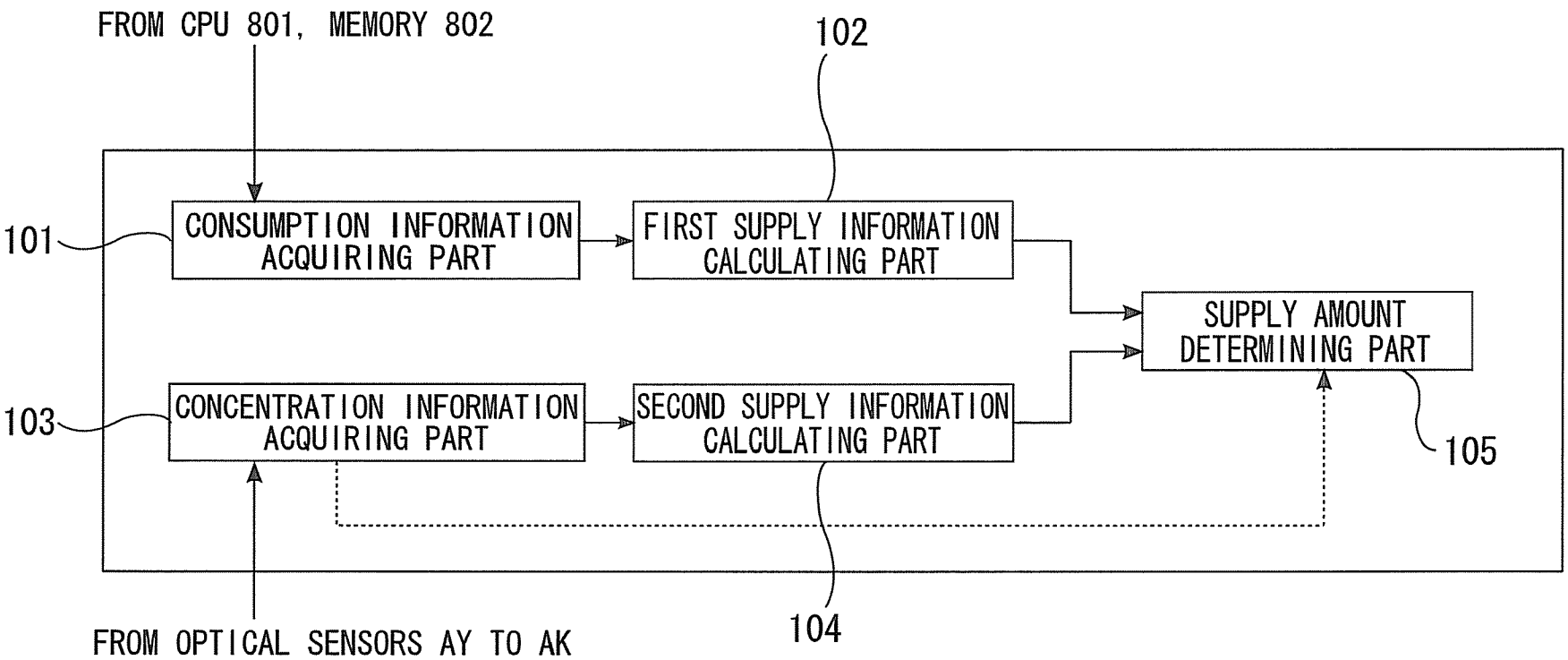
FIG. 2 is a functional block diagram for explanation of the functions of the image forming apparatus according to the first embodiment of the invention.

Next, the functions of the image forming apparatus according to the first embodiment of the invention will be described. FIG. 2 is a functional block diagram for explanation of the functions of the image forming apparatus according to the first embodiment of the invention.

As shown in FIG. 2, the image forming apparatus according to the first embodiment of the invention includes a consumption information acquiring part 101, a first supply information calculating part 102, a concentration information acquiring part 103, a second supply information calculating part 104, and a supply amount determining part 105.

First, the consumption information acquiring part 101 acquires information on amounts of consumption of the developers in the developing units EY to EK. Specifically, the consumption information acquiring part 101 acquires information on pixels of image data printed in the past (immediately before, for example) within the image forming apparatus M.

The first supply information calculating part 102 calculates "first developer supply information" indicating amounts of developers to be supplied to the developing units EY to EK based on the information acquired in the consumption information acquiring part 101.

For example, when the consumption information acquiring part 101 acquires information on the pixels of the image data (the number of pixels or the like) as a target of printing at continuous printing, the first supply information calculating part 102 calculates an amount of consumed toner by multiplying the number of basic image points in the image data of the page printed immediately before by an amount of toner attached to the basic image point, and calculates toner supply time (time taken for toner supply) Tg from the supply amount per unit time that can be supplied in the image forming apparatus M.

The concentration information acquiring part 103 acquires output values from the magnetic sensors AY to AK as information on the toner concentration in the developers contained in the developing units EY to EK.

The second supply information calculating part 104 calculates second developer supply information indicating amounts of developers to be supplied to the developing units EY to EK based on the information acquired in the concentration information acquiring part 103.

For example, the part calculates amounts of developers necessary to be supplied to the respective developing units EY to EK based on the output values from the magnetic sensors AY to AK, selects supply times taken to supply the amounts of developers to be supplied from a data table stored in the memory 802, for example, and obtains appropriate toner supply times Tm.

The supply amount determining part 105 determines information indicating amounts of developers to be supplied from the supply tanks HY to HK to the developing units EY to EK based on "first developer supply information" and "second developer supply information" calculated in the first supply information calculating part 102 and the second supply information calculating part 104.

Specifically, the supply amount determining part 105 determines one indicating the larger amount of developer supply of the first and second developer supply information calculated in the first supply information calculating part 102 and the second supply information calculating part 104 as information indicating the amounts of developers to be supplied to the developing units EY to EK.

The supply amount determining part 105 determines that the developer supply to the developing units EY to EK is unnecessary based on the information on the developer concentration acquired in the concentration information acquiring part 103, if the concentration of the developers contained in the developing units EY to EK exceeds a predetermined threshold value.

The consumption information acquiring part 101 acquires at least one of the numbers of pixels of the image data used for formation of electrostatic latent images on the photoconductors 2Y to 2K, the times for light sources to emit light for formation of electrostatic latent images on the photoconductors 2Y to 2K, character types, and areas to be exposed.

Subsequently, a flow of processing (a method of determining amounts of developer supply) in the image forming apparatus according to the first embodiment of the invention will be described.

Figure 3:
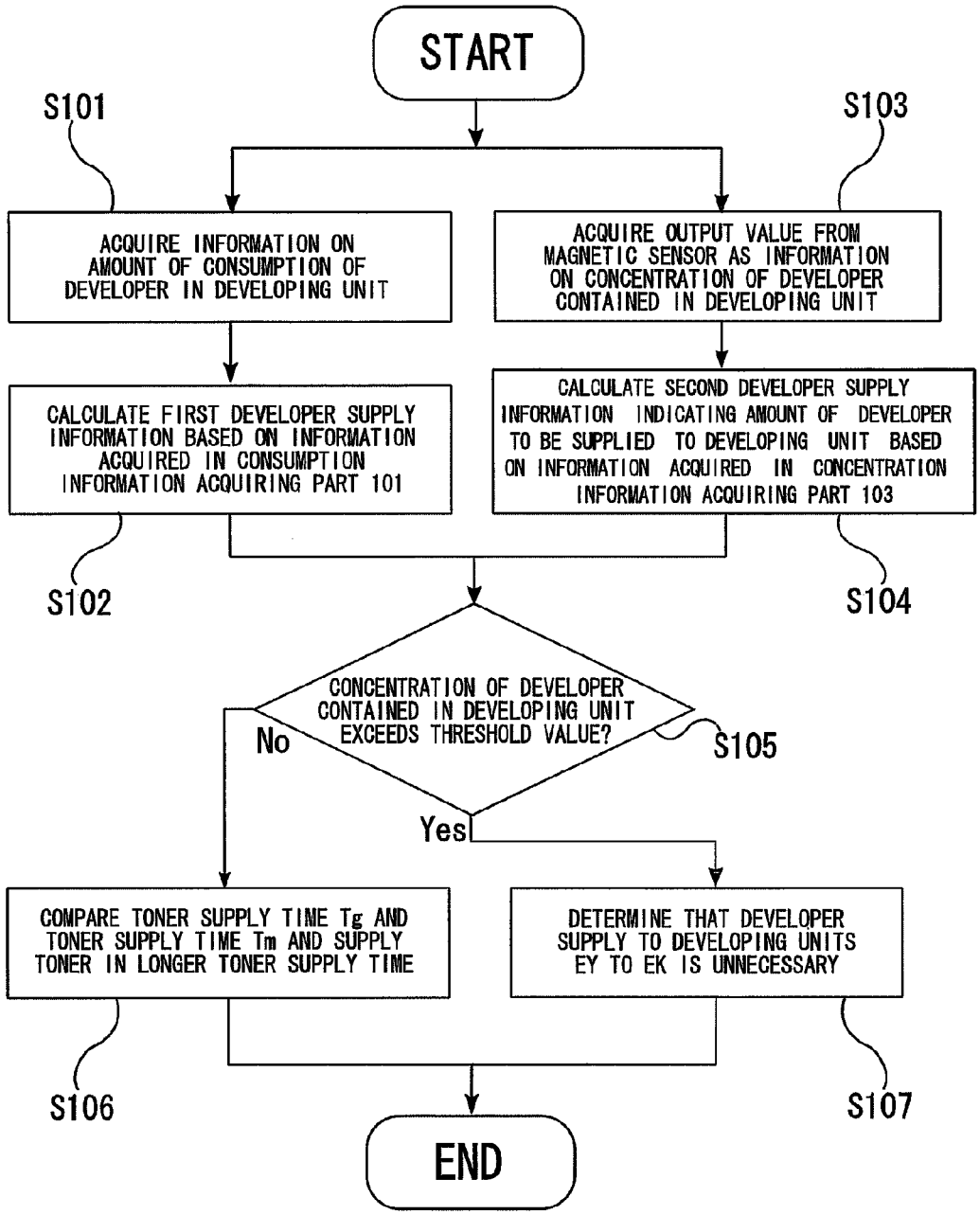
FIG. 3 is a flowchart for explanation of the flow of the processing in the image forming apparatus according to the first embodiment of the invention.
Figure 4:
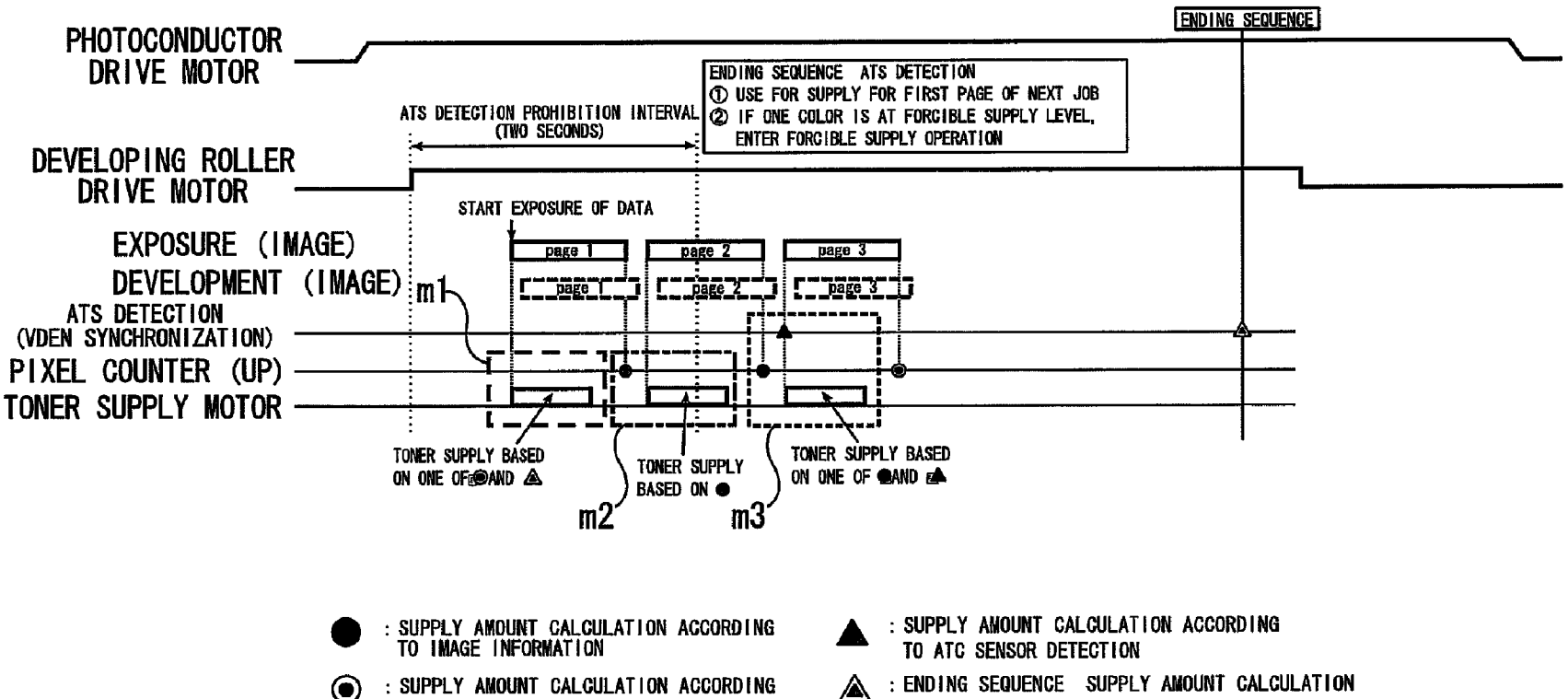
FIG. 4 is a diagram for explanation of a toner supply sequence in the image forming apparatus according to the first embodiment of the invention.

FIG. 3 is a flowchart for explanation of the flow of the processing in the image forming apparatus according to the first embodiment of the invention. Further, FIG. 4 is a diagram for explanation of a toner supply sequence in the image forming apparatus according to the first embodiment of the invention.

First, the consumption information acquiring part 101 acquires information on amounts of consumption of the developers in the developing units EY to EK (Act 101).

The first supply information calculating part 102 calculates "first developer supply information" indicating amounts of developers to be supplied to the developing units EY to EK based on the information acquired in the consumption information acquiring part 101 (Act 102).

The concentration information acquiring part 103 acquires output values from the magnetic sensors AY to AK as information on the concentration in the developers contained in the developing units EY to EK (Act 103).

The second supply information calculating part 104 calculates second developer supply information indicating amounts of developers to be supplied to the developing units EY to EK based on the information acquired in the concentration information acquiring part 103 (Act 104).

The supply amount determining part 105 determines whether the concentration of the developers contained within the developing units EY to EK exceeds a predetermined threshold value or not based on the acquired information on developer concentration (Act 105).

If the developer concentration is not more than the predetermined threshold value (Act 105, No), the supply amount determining part 105 determines one indicating the larger amount of developer supply of "first developer supply information" and "second developer supply information" calculated in the first supply information calculating part 102 and the second supply information calculating part 104 as information indicating the amounts of developers to be supplied to the developing units EY to EK (Act 105).

Specifically, the supply amount determining part 105 compares the toner supply times Tg and the toner supply times Tm, and supplies toner in the longer toner supply times (Act 106). Here, for the first page from the start of printing without the previous page, the part adopts the toner supply time obtained from pixel information of the image data of the last page in the job executed immediately before.

In view of characteristics of the magnetic sensor, the toner supply time Tm calculated under the condition that the detection value is unstable (for example, in several seconds after stirring by the mixer is started) is assumed as "0", and thereby, appropriate toner supply can be realized even under the condition that the reliability of the detection value in the magnetic sensor is low.

On the other hand, if the developer concentration detected by the magnetic sensors AY to AK exceeds the predetermined threshold value (that is, sufficient toner concentration without the need for toner supply) (Act 105, Yes), or if the developer concentration contained within the developing units EY to EK exceeds the predetermined threshold value, the part determines that the developer supply to the developing units EY to EK is unnecessary (Act 107).

In this regard, the supply amount determining part 105 assumes the toner supply time Tg calculated from the pixel information of the image data of the previous page as "0" and assumes both the toner supply times Tg and Tm as "0", and consequently, the toner supply time=0 and toner is not supplied.

If the amount of toner consumption by actual printing processing is smaller than the amount of toner consumption estimated based on the number of pixels, when toner is supplied based only on the number of pixels, the toner concentration of the developer contained within the developer unit may gradually rises and finally exceed the upper limit. On the other hand, according to the embodiment, whether toner is supplied or not is determined based on the detection value by the magnetic sensor, and thereby, the situation that the toner concentration within the developing unit abnormally rises can be avoided.

In FIG. 4, "ATS" refers to Auto Toner Sensor.

Further, "m1" is an interval at which toner is supplied in the larger supply amount of the amount of toner supply based on the information of the number of pixels of the image finally printed in the job immediately before and the amount of toner supply based on the detection value by the ATC sensor (toner concentration sensor).

"m2" is an interval at which toner is supplied in the supply amount to be supplied according to the count value of the number of pixels of the image of the page printed immediately before.

"m3" is an interval at which toner is supplied in the larger supply amount of the amount of toner supply based on the count value of the number of pixels of the image of the page printed immediately before and the amount of toner supply based on the detection values in the magnetic sensors AY to AK (ATC sensor detection levels at timing when VDEN is turned ON).

Figure 5:
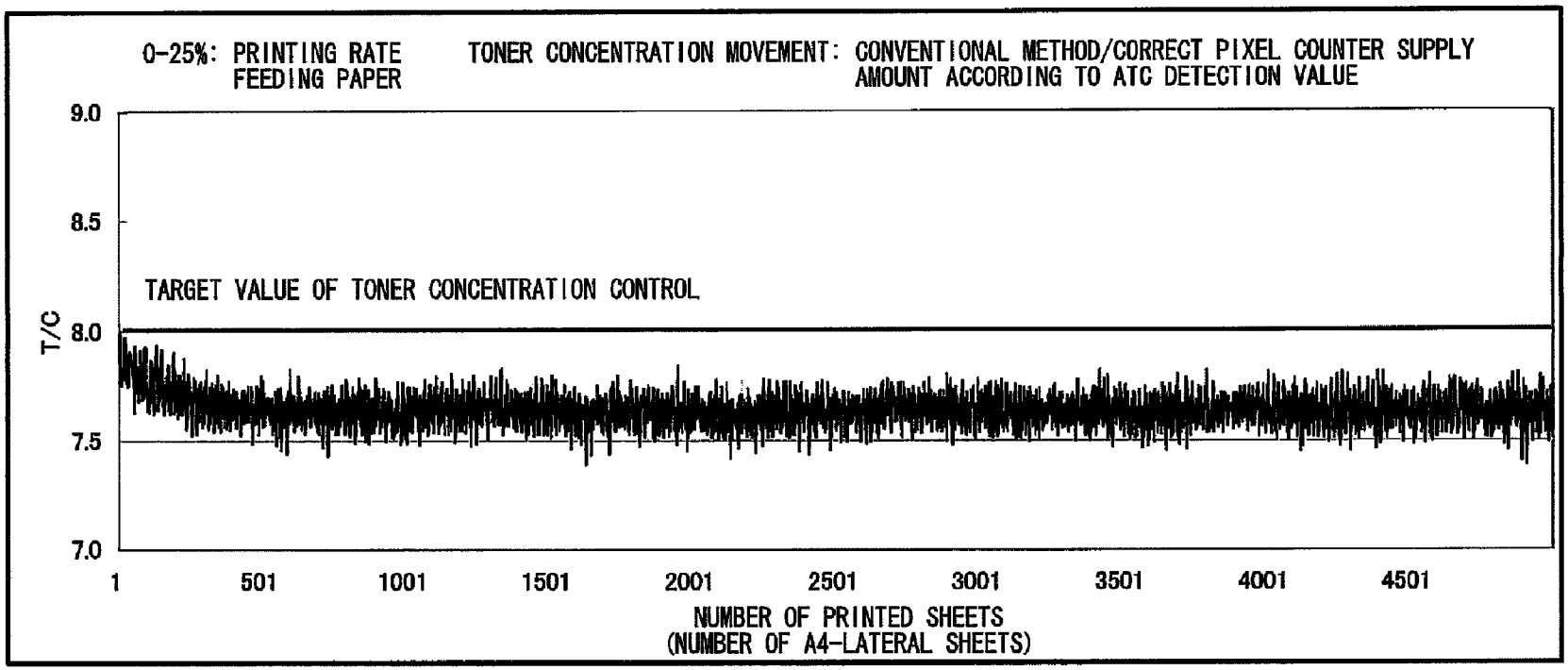
FIG. 5 is a graph showing the movement of toner concentration when printing processing at a printing rate of 0 to 25% is continuously performed in the conventional method of toner supply.
Figure 6:
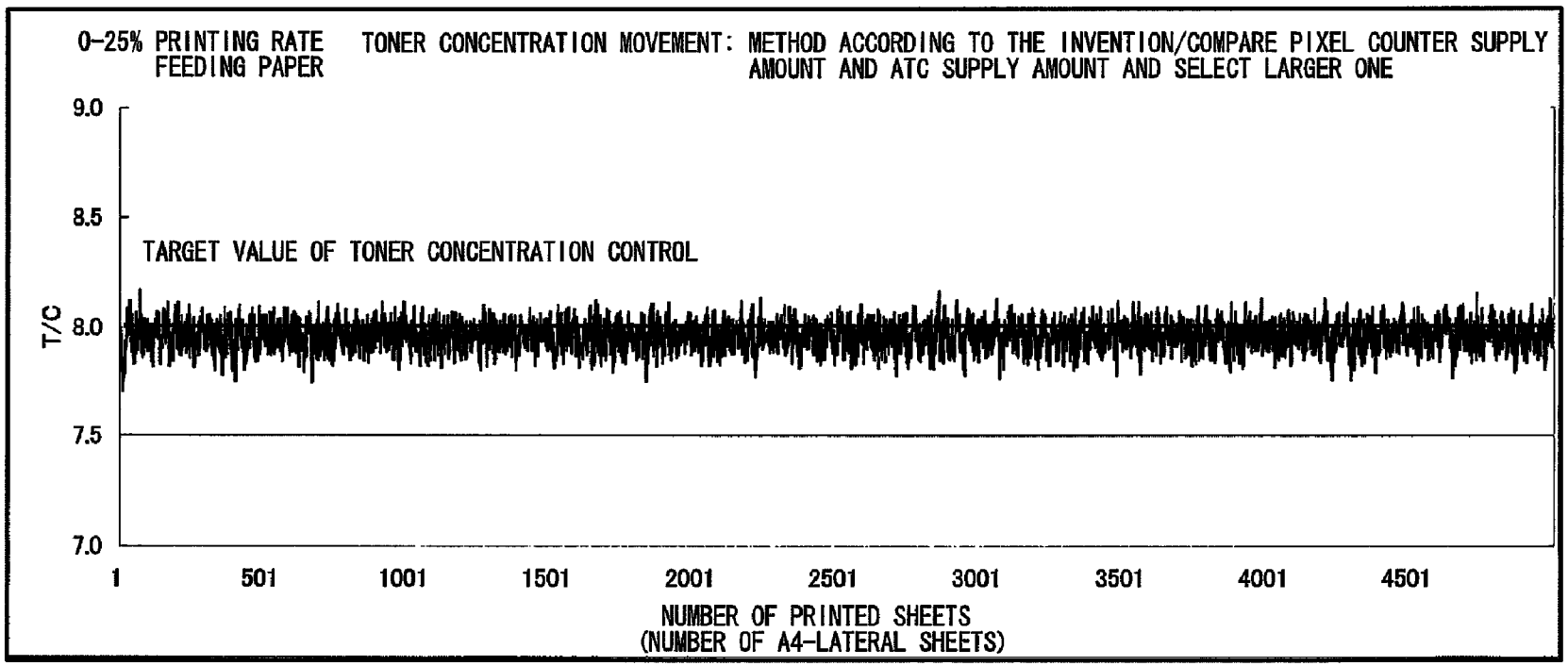
FIG. 6 is a graph showing the movement of toner concentration when printing processing at a printing rate of 0 to 25% is continuouslyperformed in the first embodiment of the invention.
Figure 7:
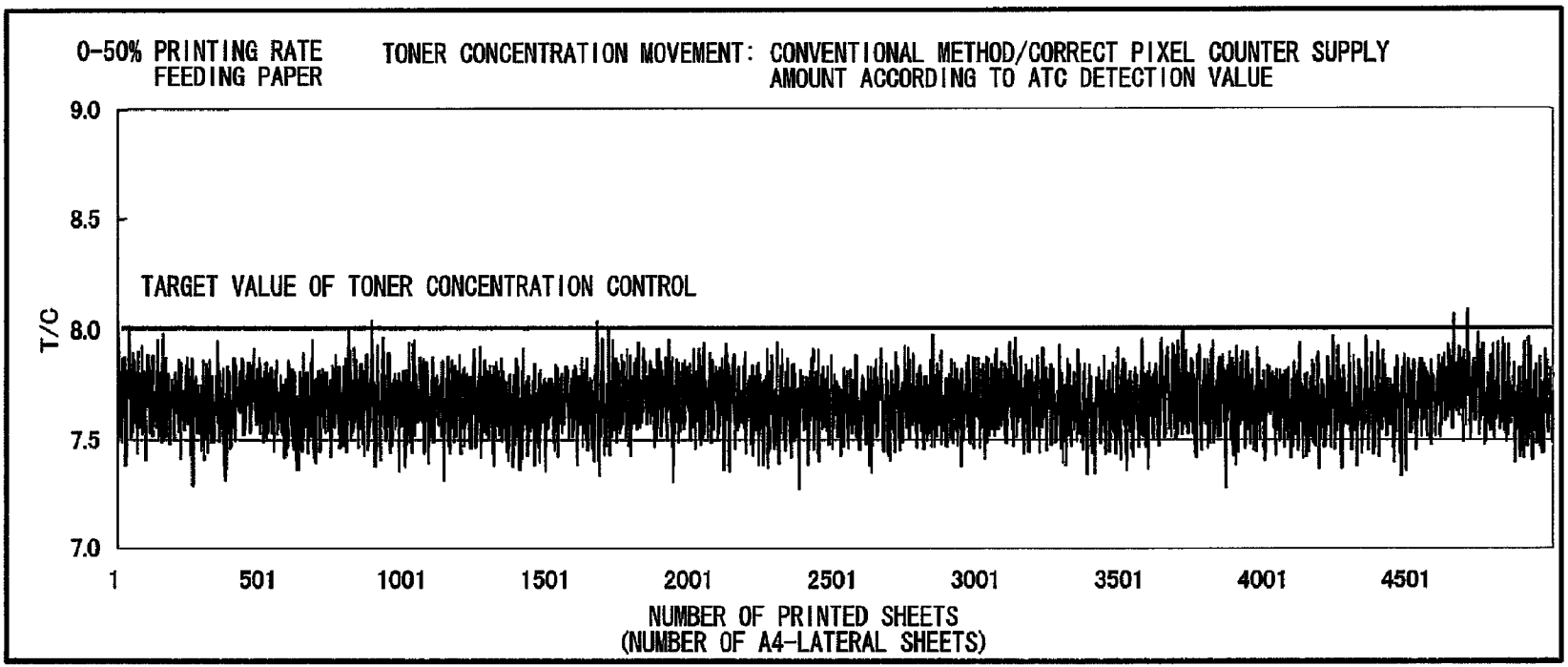
FIG. 7 is a graph showing the movement of toner concentration when printing processing at a printing rate of 0 to 50% is continuously performed in the conventional method of toner supply.
Figure 8:
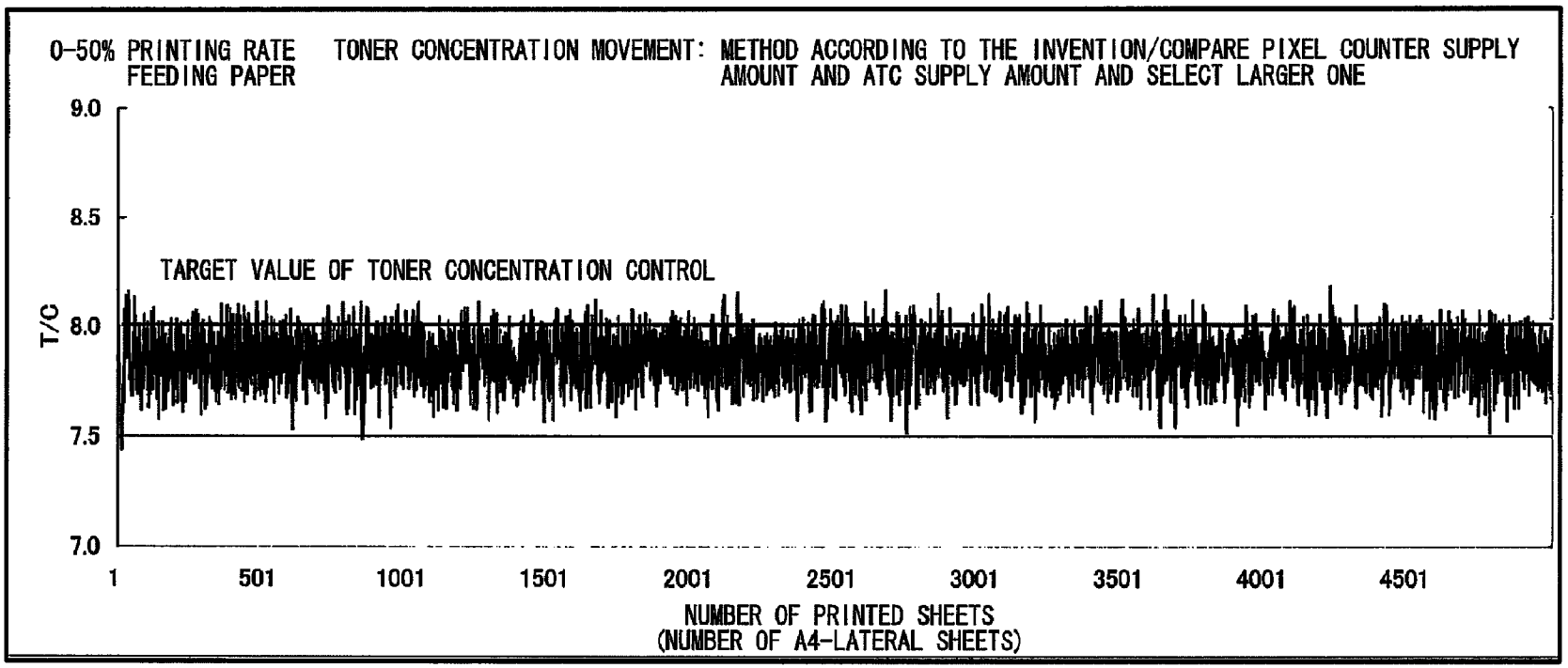
FIG. 8 is a graph showing the movement of toner concentration when printing processing at a printing rate of 0 to 50% is continuously performed in the first embodiment of the invention.

FIG. 5 is a graph showing the movement of toner concentration when printing processing at a printing rate of 0 to 25% is continuously performed in the conventional method of toner supply. FIG. 6 is a graph showing the movement of toner concentration when printing processing at a printing rate of 0 to 25% is continuously performed in the first embodiment of the invention. FIG. 7 is a graph showing the movement of toner concentration when printing processing at a printing rate of 0 to 50% is continuously performed in the conventional method of toner supply. FIG. 8 is a graph showing the movement of toner concentration when printing processing at a printing rate of 0 to 50% is continuously performed in the first embodiment of the invention.

As shown in FIGS. 5 to 8, it is known that there is little difference in variations of the movement of the toner concentration between the conventional method of toner supply and the method of toner supply in the embodiment. However, in the comparison with the target value for controlling the toner concentration, the toner concentration moves nearer the target value for controlling the toner concentration in the toner supply according to the embodiment in both cases where printing processing at the printing rate of 0 to 25% and printing processing at the printing rate of 0 to 50% are performed. Thereby, the advantage of the method of toner supply according to the embodiment over the conventional technology can be confirmed.

As described above, according to the first embodiment of the invention, stable toner concentration control can be realized by the simple method of comparing the toner supply time Tg and the toner supply time Tm and selecting the larger one.

Further, if the condition that the predetermined upper toner concentration is exceeded is detected by the magnetic sensor, the time taken to return to the normal toner concentration can be shortened by stopping the toner supply.

Second Embodiment

Subsequently, the second embodiment of the invention will be described.

The second embodiment of the invention is a modified example of the above described first embodiment. The embodiment is different from the first embodiment in the calculation algorithm of the amount of developer supply.

A supply amount determining part 105*b* in the embodiment determines one value located from one value to the other value of the first developer supply information calculated in the first supply information calculating part 102 and the second developer supply information calculated in the second supply information calculating part 104 as information indicating amounts of developers to be supplied to the developing units EY to EK.

For example, if the first developer supply information is Tm [sec] and the second developer supply information is Tg [sec], the time Ta [sec] taken to supply the amounts of toner to be supplied to the developing units EY to EK is obtained by $$Ta=(Tg+Tm)\times(n/2).$$

If the time Ta is calculated to fall within a range between the time Tg and the time Tm, the coefficient n here may be set to a value between (2×Tm)/(Tg+Tm) and (2×Tg)/(Tg+Tm), for example.

Further, the larger the output values from the magnetic sensors AY to AK acquired in the concentration information acquiring part 103, the larger value the coefficient n may be set to.

In addition, the larger the information on the amounts of consumption of the developers acquired in the consumption information acquiring part 101 (e.g., the number of pixels of the image data as a target of printing or the like), the larger value the coefficient n may be set to.

Third Embodiment

Subsequently, the third embodiment of the invention will be described.

The third embodiment of the invention is a modified example of the above described first embodiment. The embodiment is different from the respective embodiments described above in the calculation algorithm of the amount of developer supply.

A supply amount determining part 105*c* in the embodiment determines an average value of the first developer supply information calculated in the first supply information calculating part 102 and the second developer supply information calculated in the second supply information calculating part 104 as information indicating amounts of developers to be supplied to the developing units EY to EK.

For example, if the first developer supply information is 10 [sec] and the second developer supply information is 15 [sec], the time taken to supply the amounts of toner to be supplied to the developing units EY to EK is 12.5 [sec].

Fourth Embodiment

Subsequently, the fourth embodiment of the invention will be described.

The fourth embodiment of the invention is a modified example of the above described respective embodiments. The embodiment is different from the above described respective embodiments in the method of acquiring information on developer concentration.

Figure 9:
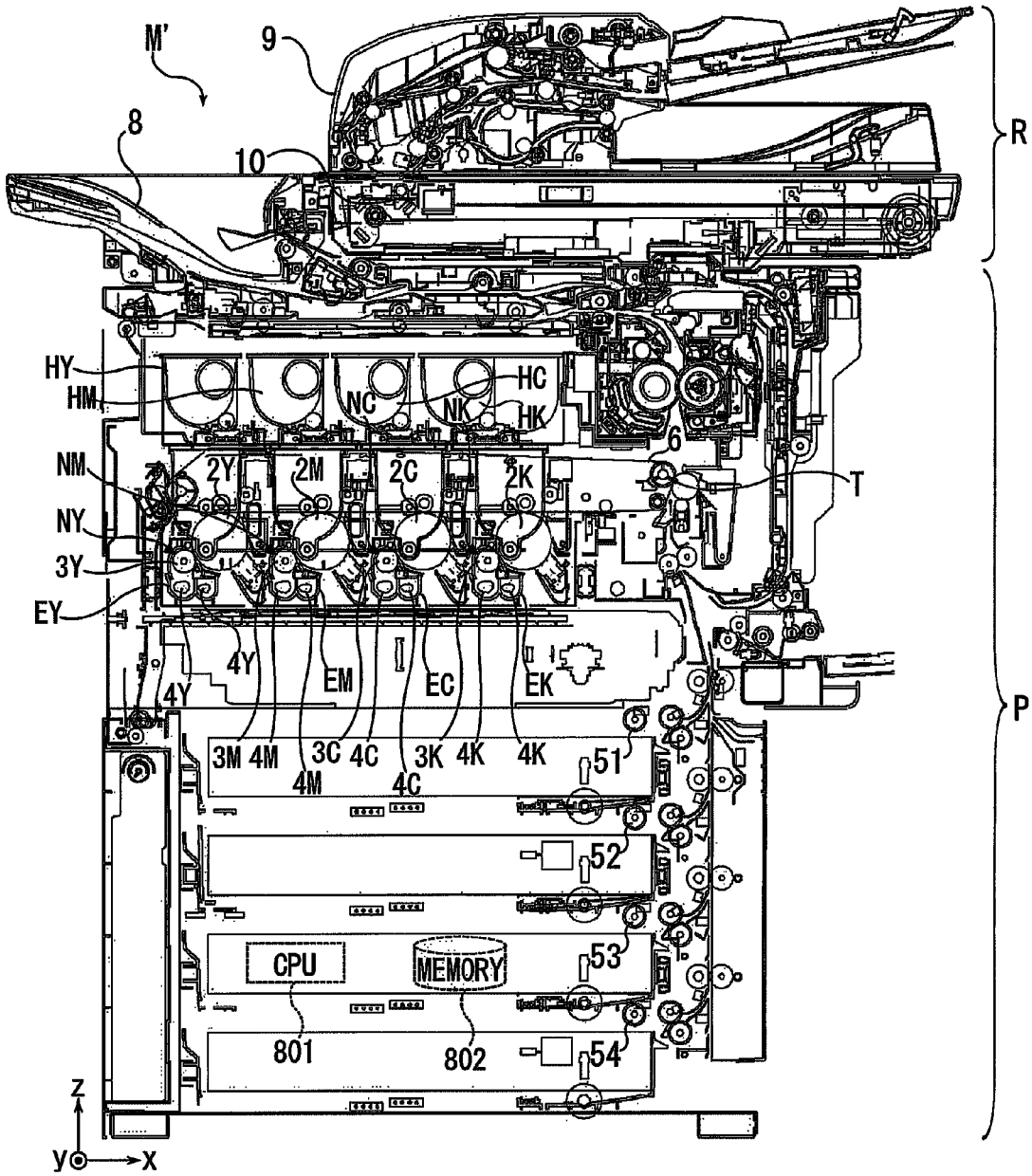
FIG. 9 is a longitudinal sectional view showing a configuration of an image forming apparatus according to the fourth embodiment of the invention.

FIG. 9 is a longitudinal sectional view showing a configuration of an image forming apparatus according to the fourth embodiment of the invention.

The image forming apparatus M' according to the embodiment includes optical sensors NY to NK in place of the magnetic sensors AY to AK shown in FIG. 1.

The optical sensors NY to NK has a function of detecting the concentration of the developers held on the developing rollers 3Y to 3K as information on the concentration of the developers contained within the respective developing units EY to EK.

The concentration information acquiring part 103 acquires output values from the optical sensors NY to NK as information on the concentration of the developers contained within the developing units EY to EK.

In this manner, since the optical sensors NY to NK apply infrared light to the developers held on the developing rollers 3Y to 3K (Mg sleeves) in the developing units EY to EK and detect the toner concentration from the intensity of the reflected light, it is unnecessary to provide a detection prohibition interval (intervals where the stability of the detection values is low) in the case of employing the magnetic sensors and more stable toner supply control can be realized.

Fifth Embodiment

Subsequently, the fifth embodiment of the invention will be described.

The fifth embodiment of the invention is a modified example of the above described respective embodiments. The embodiment is different from the above described respective embodiments in the method of acquiring information on developer concentration.

The image forming apparatus according to the fifth embodiment of the invention detects changes in weights of the developers filling a fixed volume with respect to the developers contained within the developing units EY to EK and calculates the toner concentration based on the detection values instead of using the magnetic sensors AY to AK shown in FIG. 1.

The respective acts in the processing (the method of determining amounts of developer supply) in the above described image forming apparatus are realized by allowing the CPU 801 to execute the program of determining amounts of developer supply stored in the memory 802.

Further, the program for executing the above described respective acts in a computer included in the image forming apparatus according to the above described embodiment may be supplied as a program of determining amounts of developer supply. In the embodiment, the case where the program for realizing the functions implementing the invention is recorded in a recording area provided within the apparatus in advance is shown as an example, however, not limited to that, the same program may be downloaded from a network, or a computer-readable recording medium storing the same program may be installed in the apparatus. As the recording medium, any form may be used as long as it is a computer-readable recording medium that can store programs. Specifically, as the recording medium, for example, there are an internal memory device such as ROM and RAM internally mounted in a computer, a portable recording medium such as CD-ROM, flexible disk, DVD disk, magneto-optical disk, IC card, a database holding computer programs, or another computer and a database thereof, a transmission medium on the communication line, or the like. Regarding such functions obtained by installing and downloading in advance, the function may be realized in cooperation with OS (operating system) within the apparatus or the like.

The program in the embodiment includes a program in which the execution module is dynamically generated.

In the above respective embodiments, the times (Tg and Tm) taken to supply toner to be supplied to the developing units are shown as "first developer supply information indicating amounts of developers to be supplied to the developing units", "second developer supply information indicating amounts of developers to be supplied to the developing units", and "information indicating amounts of developers to be supplied to the developing units" for an example, the information is not limited to those.

For example, as "first developer supply information indicating amounts of developers to be supplied to the developing units", "second developer supply information indicating amounts of developers to be supplied to the developing units", and "information indicating amounts of developers to be supplied to the developing units", the amounts of toner to be supplied to the developing units (e.g., [g], [ml], [$cm^3$], or the like) may be adopted, or the number of drive steps of motors necessary for supplying toner to be supplied into the developing units or the like may be adopted.

Further, in the above respective embodiments, the configuration of acquiring information on the pixels of the image data previously printed in the consumption information acquiring part is taken as an example, however, the configuration is not limited to that. For example, if the amounts of toner necessary to be supplied is desired to be calculated after the information for estimating the amounts of toner to be consumed is acquired in advance, the consumption information acquiring part may acquire information on the number of pixels of the image data to be printed or the like.

Furthermore, in the above respective embodiments, the configuration of optically detecting the toner concentration of the developers held on the developing rollers in the developing units is shown as an example, however, the configuration is not limited to that. For example, if the configuration can optically detect the toner concentration of the developers contained within the developer units, the toner concentration of the developers contained within the developer units may optically be detected.

Moreover, in the above respective embodiments, the configuration of adopting magnetic sensors and optical sensors in order to measure the toner concentration of the two-component developers contained in the developing units is taken as an example, however, the configuration is not limited to that, any sensors may be used as long as they can consequently detect the toner concentration of the two-component developers contained in the developing units.

In addition, in the above respective embodiments, the processing procedure of acquiring the information on the amounts of consumption of the developers in the developing units and the information on the concentration of the developers contained within the developing units in parallel is shown as an example (for example, see FIG. 3), however, the procedure is not limited to that. That is, both of the above described information may consequently acquired at timing when they are necessary. For example, one of the information on the amounts of consumption of the developers in the developing units and the information on the concentration of the developers contained within the developing units may be acquired at first, and then, the other may be acquired.

Further, in the above respective embodiments, for convenience of explanation, the developing unit as a target of determination of the amount of toner supply is not specified and explained, however, it is obvious that the amounts of toner supply can be determined independently with respect to each of the developing units EY to EK based on the consumption statuses of the respective colors, the toner concentration statuses of the developing units to which the toner of the respective colors are supplied, or the like.

Furthermore, in the above respective embodiments, the case where "developer" as a target of supply is mainly toner is taken as an example, however, not limited to that, for example, the developer as a target of supply may include both toner and carrier in a configuration in which also the carrier can be supplied based on the consumption status and the degradation status.

The invention is described according to particular embodiments in detail, however, it would be known to those skilled in the art that various changes and alterations can be made without departing the spirit and scope of the invention.

According to the invention as described in detail, a technology that can realize appropriate developer supply processing according to the statuses of the developing units using a simple method can be provided.

What is claimed is:

1. An image forming apparatus that visualizes an electrostatic latent image formed on a photoconductor with a developing unit, comprising:

a consumption information acquiring part that acquires information on an amount of consumption of a developer in the developing unit;

a first supply information calculating part that calculates first developer supply information indicating an amount of developer to be supplied to the developing unit based on the information acquired in the consumption information acquiring part;

a concentration information acquiring part that acquires information on concentration of the developer contained within the developing unit;

a second supply information calculating part that calculates second developer supply information indicating an amount of developer to be supplied to the developing unit based on the information acquired in the concentration information acquiring part; and a supply amount determining part that determines information indicating an amount of developer to be supplied to the developing unit based on the first and second developer supply information calculated in the first and second supply information calculating parts.

2. The apparatus according to claim 1, wherein the supply amount determining part determines one indicating the larger amount of developer supply of the first and second developer supply information calculated in the first supply information calculating part and the second supply information calculating part as information indicating the amount of developer to be supplied to the developing unit.

3. The apparatus according to claim 1, wherein the supply amount determining part determines one value located from one value to the other value of the first developer supply information calculated in the first supply information calculating part and the second developer supply information calculated in the second supply information calculating part as information indicating the amount of developer to be supplied to the developing unit.

4. The apparatus according to claim 1, wherein the supply amount determining part determines an average value of the first developer supply information calculated in the first supply information calculating part and the second developer supply information calculated in the second supply information calculating part as information indicating the amount of developer to be supplied to the developing unit.

5. The apparatus according to claim 1, wherein the supply amount determining part determines that the developer supply to the developing unit is unnecessary based on the information on the developer concentration acquired in the concentration information acquiring part, if the concentration of the developer contained in the developing unit exceeds a predetermined threshold value.

6. The apparatus according to claim 1, wherein the consumption information acquiring part acquires at least one of the number of pixels of image data used for formation of the electrostatic latent image on the photoconductor, time for a light source to emit light for formation of the electrostatic latent image on the photoconductor, character type, and area to be exposed.

7. The apparatus according to claim 1, further comprising:

a developing roller for carrying the developer contained within the developing unit to the photoconductor; and an optical sensor that detects concentration of the developer held on the developing roller, wherein the concentration information acquiring part acquires an output value from the optical sensor.

8. The apparatus according to claim 1, further comprising a magnetic sensor that outputs a voltage corresponding to permeability of the developer contained within the developing unit, wherein the concentration information acquiring part acquires an output value from the magnetic sensor.

9. The apparatus according to claim 1, further comprising an optical sensor that detects the concentration of the developer contained within the developing unit, wherein the concentration information acquiring part acquires a detection value in the optical sensor.

10. A method of determining an amount of developer supply in an image forming apparatus that visualizes an electrostatic latent image formed on a photoconductor with a developing unit, comprising:

acquiring information on an amount of consumption of a developer in the developing unit;

calculating first developer supply information indicating an amount of developer to be supplied to the developing unit based on the acquired information;

acquiring information on concentration of the developer contained within the developing unit;

calculating second developer supply information indicating an amount of developer to be supplied to the developing unit based on the acquired information; and determining information indicating an amount of developer to be supplied to the developing unit based on the calculated first and second developer supply information.

11. The method according to claim 10, wherein one indicating the larger amount of developer supply of the calculated first and second developer supply information is determined as information indicating the amount of developer to be supplied to the developing unit.

12. The method according to claim 10, wherein one value located from one value to the other value of the calculated first developer supply information and second developer supply information is determined as information indicating the amount of developer to be supplied to the developing unit.

13. The method according to claim 10, wherein an average value of the calculated first developer supply information and second developer supply information is determined as information indicating the amount of developer to be supplied to the developing unit.

14. The method according to claim 10, wherein a determination that the developer supply to the developing unit is unnecessary is made based on the acquired information on the developer concentration, if the concentration of the developer contained in the developing unit exceeds a predetermined threshold value.

15. The method according to claim 10, wherein at least one of the number of pixels of image data used for formation of the electrostatic latent image on the photoconductor, time for a light source to emit light for formation of the electrostatic latent image on the photoconductor, character type, and area to be exposed is acquired as the information on the amount of consumption of the developer in the developing unit.

16. The method according to claim 10, wherein a value obtained by an optical sensor detecting concentration of the developer held on a developing roller for carrying the developer contained within the developing unit to the photoconductor is acquired as the information on the concentration of the developer contained within the developing unit.

17. The method according to claim 10, wherein a voltage value output from a magnetic sensor corresponding to permeability of the developer contained within the developing unit is acquired as the information on the concentration of the developer contained within the developing unit.

18. The method according to claim 10, wherein a value obtained by an optical sensor detecting the concentration of the developer contained within the developing unit is acquired as the information on the concentration of the developer contained within the developing unit.

19. A non-transitory computer readable medium storing a program for causing a computer to execute a method of determining an amount of developer supply in an image forming apparatus that visualizes an electrostatic latent image formed on a photoconductor with a developing unit, allowing the computer to execute processing of:

acquiring information on an amount of consumption of a developer in the developing unit;

calculating first developer supply information indicating an amount of developer to be supplied to the developing unit based on the acquired information;

acquiring information on concentration of the developer contained within the developing unit;

calculating second developer supply information indicating an amount of developer to be supplied to the developing unit based on the acquired information; and determining information indicating an amount of developer to be supplied to the developing unit based on the calculated first and second developer supply information.

20. The non-transitory computer readable medium according to claim 19, allowing the computer to execute processing of determining one indicating the larger amount of developer supply of the calculated first and second developer supply information as information indicating the amount of developer to be supplied to the developing unit.

* * * * *